US011448406B2

(12) United States Patent
Rosén

(10) Patent No.: US 11,448,406 B2
(45) **Date of Patent: *Sep. 20, 2022**

(54) LOCAL THERMAL ENERGY CONSUMER ASSEMBLY AND A LOCAL THERMAL ENERGY GENERATOR ASSEMBLY FOR A DISTRICT THERMAL ENERGY DISTRIBUTION SYSTEM

(71) Applicant: E. ON Sverige AB, Malmo (SE)

(72) Inventor: Per Rosén, Lund (SE)

(73) Assignee: E. ON SVERIGE AB, Malmö (SE)

( * ) Notice: Subject to any disclaimer, the term of this patent is extended or adjusted under 35 U.S.C. 154(b) by 462 days.

This patent is subject to a terminal disclaimer.

(21) Appl. No.: 16/487,837

(22) PCT Filed: Mar. 6, 2018

(86) PCT No.: PCT/EP2018/055455
§ 371 (c)(1),
(2) Date: Aug. 22, 2019

(87) PCT Pub. No.: WO2018/162468
PCT Pub. Date: Sep. 13, 2018

(65) Prior Publication Data

US 2020/0232652 A1 Jul. 23, 2020

(30) Foreign Application Priority Data

Mar. 7, 2017 (EP) ..... 17159573

(51) Int. Cl.
*F24D 10/00* (2022.01)
*E03B 1/04* (2006.01)
(Continued)

(52) U.S. Cl.
CPC ..... *F24D 10/003* (2013.01); *E03B 1/04* (2013.01); *E03B 5/00* (2013.01); *E03B 7/02* (2013.01);
(Continued)

(58) Field of Classification Search
CPC ..... E03B 5/00; E03B 7/02; E03B 1/04; E03B 7/078; F24D 10/003; F24D 19/1006;
(Continued)

(56) References Cited

U.S. PATENT DOCUMENTS

2005/0081507 A1* 4/2005 Tumelty ..... F02C 7/224 60/39.08
2012/0279681 A1* 11/2012 Vaughan ..... F24D 10/00 165/62
(Continued)

FOREIGN PATENT DOCUMENTS

DE 1209716 B 1/1966
DE 10 2007 062402 A1 6/2009
(Continued)

OTHER PUBLICATIONS

International Search Report and Written Opinion dated Jun. 29, 2018 for PCT/EP2018/055455 filed on Mar. 6, 2018, 10 pages.

*Primary Examiner* — Steven B McAllister
*Assistant Examiner* — John E Bargero
(74) *Attorney, Agent, or Firm* — Xsensus LLP

(57) ABSTRACT

A local thermal energy consumer assembly and a local thermal energy generator assembly to be connected to a thermal energy circuit comprising a hot and a cold conduit. The local thermal energy consumer assembly is connected via a flow controller to the hot conduit. The local thermal energy generator assembly is connected via a flow controller to the cold conduit. The flow controller is selectively set in pumping mode or a flowing mode based on a local pressure
(Continued)

difference between heat transfer liquid of the hot and cold conduits.

15 Claims, 7 Drawing Sheets

(51) Int. Cl.

| | |
|---|---|
| ***E03B 5/00*** | (2006.01) |
| ***E03B 7/02*** | (2006.01) |
| ***E03B 7/07*** | (2006.01) |
| ***F24D 19/10*** | (2006.01) |
| ***F24F 5/00*** | (2006.01) |

(52) U.S. Cl.
CPC ..... *E03B 7/078* (2013.01); *F24D 19/1006* (2013.01); *F24D 19/1036* (2013.01); *F24F 5/0096* (2013.01)

(58) Field of Classification Search
CPC .... F24D 19/1036; F24F 5/0096; Y02B 30/17; Y02E 20/14
See application file for complete search history.

(56) References Cited

U.S. PATENT DOCUMENTS

2015/0083362 A1* 3/2015 Liu ..... F24T 10/10 165/45
2015/0369494 A1* 12/2015 Skovmose Kallesoe ..... F24D 19/1015 165/247

FOREIGN PATENT DOCUMENTS

| | | | |
|---|---|---|---|
| EP | 2685174 | A1 | 1/2014 |
| EP | 3165831 | A1 | 5/2017 |
| KR | 10-2011-0137619 | A | 12/2011 |
| KR | 10-2012-0033330 | A | 4/2012 |
| WO | 95/20134 | A1 | 7/1995 |
| WO | 2010/145040 | A1 | 12/2010 |

* cited by examiner

LOCAL THERMAL ENERGY CONSUMER ASSEMBLY AND A LOCAL THERMAL ENERGY GENERATOR ASSEMBLY FOR A DISTRICT THERMAL ENERGY DISTRIBUTION SYSTEM

CROSS-REFERENCE TO RELATED APPLICATIONS

The present application is based on PCT filing PCT/EP2018/055455, filed Mar. 6, 2018, which claims priority to EP 17159573.9, filed Mar. 7, 2017, the entire contents of each are incorporated herein by reference.

FIELD OF THE INVENTION

The invention relates to a local thermal energy consumer assembly and a local thermal energy generator assembly to be connected to a thermal energy circuit comprising a hot and a cold conduit.

BACKGROUND OF THE INVENTION

Nearly all large developed cities in the world have at least two types of energy grids incorporated in their infrastructures; one grid for providing electrical energy and one grid for providing space heating and hot tap water preparation. Today a common grid used for providing space heating and hot tap water preparation is a gas grid providing a burnable gas, typically a fossil fuel gas. The gas provided by the gas grid is locally burned for providing space heating and hot tap water. An alternative for the gas grid for providing space heating and hot tap water preparation is a district heating grid. Also the electrical energy of the electrical energy grid may be used for space heating and hot tap water preparation. Also the electrical energy of the electrical energy grid may be used for space cooling. The electrical energy of the electrical energy grid is further used for driving refrigerators and freezers.

Accordingly, traditional building heating and cooling systems use primary high grade energy sources such as electricity and fossil fuels or an energy source in the form of industrial waste heat to provide space heating and/or cooling, and to heat or cool water used in the building. Furthermore, it has been increasingly common to also install a district cooling grid in cities for space cooling. The process of heating or cooling the building spaces and water converts this high grade energy into low grade waste heat with high entropy which leaves the building and is returned to the environment.

Hence, there is a need for improvements in how to provide heating and cooling to a city.

SUMMARY OF THE INVENTION

It is an object of the present invention to solve at least some of the problems mentioned above.

According to a first aspect a local thermal energy consumer assembly is provided. The local thermal energy consumer assembly is arranged to be connected to a thermal energy circuit comprising a hot conduit configured to allow heat transfer liquid of a first temperature to flow therethrough, and a cold conduit configured to allow heat transfer liquid of a second temperature to flow therethrough, the second temperature is lower than the first temperature. The local thermal energy consumer assembly comprising:

a consumer assembly pressure difference determining device adapted to determine a consumer assembly local pressure difference, $\Delta p1$, of the thermal energy circuit;

a thermal energy consumer heat exchanger; and a flow controller, wherein the thermal energy consumer heat exchanger is arranged to be connected to the hot conduit via the flow controller, wherein the flow controller comprises a mode controller configured to, based on $\Delta p1$, selectively set the flow controller in a pumping mode or in a flowing mode, wherein upon set in the pumping mode the flow controller is configured to act as a pump for pumping heat transfer liquid from the hot conduit into the thermal energy consumer heat exchange, and wherein upon set in flowing mode the flow controller is configured to act as a flow regulator for allowing heat transfer liquid from the hot conduit to flow into the thermal energy consumer heat exchanger, wherein the thermal energy consumer heat exchanger is further arranged to be connected to the cold conduit for allowing return of heat transfer liquid from the thermal energy consumer heat exchanger to the cold conduit, and wherein the thermal energy consumer heat exchanger is arranged to transfer thermal energy from heat transfer liquid to surroundings of the thermal energy consumer heat exchanger, such that heat transfer liquid returned to the cold conduit has a temperature lower than the first temperature and preferably a temperature equal to the second temperature.

According to a second aspect a local thermal energy generator assembly is provided. The local thermal energy generator assembly is arranged to be connected to a thermal energy circuit comprising a hot conduit configured to allow heat transfer liquid of a first temperature to flow therethrough, and a cold conduit configured to allow heat transfer liquid of a second temperature to flow therethrough, the second temperature is lower than the first temperature. The the local thermal energy generator assembly comprising:

a generator assembly pressure difference determining device adapted to determine a generator assembly local pressure difference, $\Delta p2$, of the thermal energy circuit;

a thermal energy generator heat exchanger; and a flow controller, wherein the thermal energy generator heat exchanger is arranged to be connected to the cold conduit via the flow controller, wherein the flow controller comprises a mode controller configured to, based on $\Delta p2$, selectively set the flow controller in a pumping mode or in a flowing mode, wherein upon set in the pumping mode the flow controller is configured to act as a pump for pumping heat transfer liquid from the cold conduit into the thermal energy generator heat exchanger, and wherein upon set in flowing mode the flow controller is configured to act as a flow regulator for allowing heat transfer liquid from the cold conduit to flow into the thermal energy generator heat exchanger, wherein the thermal energy generator heat exchanger is further arranged to be connected to the hot conduit for allowing return of heat transfer liquid from the thermal energy generator heat exchanger to the hot conduit, and wherein the thermal energy generator heat exchanger is arranged to transfer thermal energy from its surroundings to heat transfer liquid, such that the heat transfer liquid returned to hot conduit has a temperature higher than the second temperature and preferably a temperature equal to the first temperature.

The wording "selectively set the flow controller in a pumping mode or in a flowing mode" should be construed as the flow controller is at one point in time set in the pumping mode and at another point in time set in the electricity generating mode.

The wording "pump" should be construed as a device configured to, in a controlled way, allow heat transfer liquid to be pumped through the pump when the pump is in an active pumping state. In the expression "in a controlled way" it is comprised that the pump may regulate the flow rate of the fluid being pumped by the pump.

The wording "pump assembly" should be construed as an assembly of units that together are configured to, in a controlled way, allow fluid to be pumped through the flow regulator when the pump assembly is in an active state.

The wording "flow regulator assembly" should be construed as an assembly of units that together are configured to, in a controlled way, allow fluid to flow through the flow regulator assembly when the flow regulator assembly is in an active state. Moreover, the flow regulator assembly may also be arranged such that the flow rate of fluid through the flow regulator assembly may be controlled. Hence, the flow regulator assembly may be arranged to regulate the flow of fluid theretrough.

Hence, the local thermal energy consumer assembly is configured to be connected to the thermal energy circuit comprising the hot and the cold conduit. Moreover, the local thermal energy generator assembly is also configured to be connected to the thermal energy circuit comprising the hot and the cold conduit. The local thermal energy consumer assembly is connected to the hot conduit via the flow regulator selectively acting as a pump or as a flow regulator. The local thermal energy generator assembly is connected to the cold conduit via the flow regulator flow regulator selectively acting as a pump or as a flow regulator. The wording "selectively act as a pump or a flow regulator" should be construed as the flow controller is at one point in time acting as a pump and at another point in time acting as a flow regulator. The setting of the flow controller in the pumping mode or the flowing mode is controlled by determining a local pressure difference between heat transfer liquid of the hot and the cold conduits.

The local thermal energy consumer assembly and the local thermal energy generator assembly are simple to connect to the thermal energy circuit being part of a district thermal energy distribution system. The design of the thermal energy consumer assembly and the local thermal energy generator assembly allow them to be connected to a thermal energy circuit wherein the pressure between heat transfer liquid of the hot and cold conduits are allowed to vary both spatially and temporally. This since the local thermal energy consumer assembly and the local thermal energy generator assembly comprises their respective pressure difference determining device, and since they are selectively connected to the hot and cold conduit, respectively, via selectively setting the flow controller in the pumping mode or in the flowing mode. Further, the flow controller allows for an efficient flow control of heat transfer liquid between the hot and cold conduits. Moreover, the flow controller may be made physically compact. Hence, physical space may be saved. Furthermore, the flow controller allows for transfer of heat transfer liquid between the hot and cold conduits in an energy efficient manner.

The mode controller may be configured to set the flow controller in the pumping mode in case $\Delta p1$ is indicative of that a consumer assembly local pressure of heat transfer liquid in the hot conduit is lower than a consumer assembly local pressure of heat transfer liquid in the cold conduit The mode controller may further be configured to set the flow controller in the flowing mode in case $\Delta p1$ is indicative of that the consumer assembly local pressure of heat transfer liquid in the hot conduit is higher than the consumer assembly local pressure of heat transfer liquid in the cold conduit.

The mode controller may further be configured to set the flow controller in the pumping mode in case $\Delta p2$ is indicative of that a generator assembly local pressure of heat transfer liquid in the cold conduit is lower than a generator assembly local pressure of heat transfer liquid in the hot conduit The mode controller may further be configured to set the flow controller in the flowing mode in case $\Delta p2$ is indicative of that the generator assembly local pressure of heat transfer liquid in the cold conduit is higher than the generator local pressure of heat transfer liquid in the hot conduit.

The flow controller is configured to selectively act as a pump or a flow regulator for a transport of fluid from a first reservoir to a second reservoir.

The flow controller may further comprise:

an inlet for heat transfer liquid, the inlet being connectable to the first reservoir;

an outlet for heat transfer liquid; the outlet being connectable to the second reservoir;

a pump assembly arranged between the inlet and the outlet and configured to pump heat transfer liquid through the flow controller from the inlet to the outlet, thereby transporting fluid from the first reservoir to the second reservoir;

a flow regulator assembly arranged between the inlet and the outlet and configured to allow heat transfer liquid to flow through the flow controller from the inlet to the outlet, thereby transporting fluid from the first reservoir to the second reservoir, and to generate electricity by transforming flow energy of heat transfer liquid flowing through the flow controller into electricity;

wherein upon being set in the pumping mode, the mode controller is configured to activate the pump assembly and to deactivate the flow regulator assembly;

wherein upon being set in the flowing mode, the mode controller is configured to deactivate the pump assembly and to activate the flow regulator assembly.

The flow controller may further comprise a wheel, wherein the wheel is selectively operable as a pump wheel of the pump assembly to provide pump action upon the flow controller is set in the pumping mode and as a turbine wheel of the flow regulator assembly to provide hydro electrical generation upon the flow controller is set in the flowing mode.

Upon the pump assembly being in the pumping mode, the flow through the flow controller may be regulated by driving the wheel (or impeller) at different frequencies. Different predetermined frequencies correspond to different flows through the flow controller.

A direction of flow of fluid through the pump assembly and a direction of flow of fluid through the flow regulator assembly may be the same.

For some applications the flow regulator assembly may be seen as a hydro electrical generator assembly. The wording "hydro electrical generator assembly" should be construed as an assembly of units that together are configured to, in a controlled way, allow fluid to flow through the flow regulator assembly when the flow regulator assembly is in the flowing mode. Moreover, upon the flow regulator assembly is seen as the hydro electrical generator assembly it is configured to generate electricity by transforming flow energy of the fluid flowing through the flow controller into electricity when the flow regulator assembly is in the flowing mode.

The flow controller may be embodied as a centrifugal pump or as an impeller pump. For such pumps the flow of fluid going through the pump assembly may be controlled by controlling the frequency of the rotation of the wheel (or impeller) in the respective pump.

Using the wheel as both the pump wheel and the turbine wheel allow for construction of a physically compact flow controller.

The flow regulator assembly may additionally be set in a flow decreasing mode. Upon the flow regulator assembly being set in the flow decreasing mode, the flow through the flow controller may be regulated by driving the wheel (or impeller) so that the wheel (or impeller) is rotating against the flow direction. The wheel may be rotated at a predetermined frequency. By rotating the wheel against the flow direction the flow of fluid through the flow controller may be slowed down. Different predetermined frequencies correspond to different flows through the flow controller. Hence, the flow through flow controller may be deaccelerated by rotating the wheel against the direction of flow through the flow controller.

The mode controller may be configured to set the flow controller in the pumping mode or the flowing mode based on a signal indicative on a pressure difference between the fluid at the inlet and the fluid at the outlet.

The mode controller may be configured to set the flow controller in the pumping mode in case the signal is indicative of that the pressure of the fluid at the inlet is equal or lower than the pressure at the outlet. This protects the flow controller from being damaged.

The mode controller may be configured to set the flow controller in the electricity generating mode or in the flow decreasing mode in case the signal is indicative of that the pressure of the fluid at the inlet is higher than the pressure at the outlet. This further protects the flow controller from being damaged. The choice of setting the flow controller in the electricity generating mode or in the flow decreasing mode is based on a pressure difference between a pressure of the fluid at the inlet and a pressure of the fluid at the outlet. For relatively low pressure differences the mode controller is configured to set the flow controller in the electricity generating mode and for relatively high pressure differences the mode controller is configured to set the flow controller in the flow decreasing mode. The value at which the flow decreasing mode is to chosen instead of the electricity generating mode depend on the actual flow rate through the flow controller. In case of the flow rate need to be decreased due to the relatively high pressure difference the mode controller is configured to set the flow controller in the flow decreasing mode.

The flow controller may further comprise a first flow channel for the heat transfer liquid and a second flow channel for the heat transfer liquid, wherein the first flow channel forming part of the pump assembly and the second flow channel forming part of the flow regulator assembly.

According to a third aspect a district thermal energy distribution system is provided. The district thermal energy distribution system comprises:

a thermal energy circuit comprising two conduits for allowing flow of heat transfer liquid therethrough, wherein a hot conduit in the thermal energy circuit is configured to allow heat transfer liquid of a first temperature to flow therethrough, and wherein a cold conduit in the thermal energy circuit is configured to allow heat transfer liquid of a second temperature to flow therethrough, the second temperature is lower than the first temperature;

one or more local thermal energy consumer assemblies according to the first aspect; and/or one or more local thermal energy generator assemblies according to the second aspect.

According to a forth aspect a method for controlling a thermal energy generator heat exchanger being, via a flow controller, connected to a cold conduit configured to allow heat transfer liquid of a second temperature to flow therethrough, and being, via a return conduit, connected to a hot conduit configured to allow heat transfer liquid of a first temperature to flow therethrough, wherein the second temperature is lower than the first temperature, wherein the flow controller comprises a mode controller configured to selectively set the flow controller in a pumping mode or in a flowing mode, wherein upon set in the pumping mode the flow controller is configured to act as a pump for pumping heat transfer liquid from the cold conduit into the thermal energy generator heat exchanger, and wherein upon set in flowing mode the flow controller is configured to act as a flow regulator for allowing heat transfer liquid from the cold conduit to flow into the thermal energy generator heat exchanger, is provided. The method comprising:

determining a consumer assembly local pressure difference, $\Delta p1$, between heat transfer liquid of the hot conduit and heat transfer liquid of the cold conduit; and based on $\Delta p1$ selectively setting the flow controller in the pumping mode or in the flowing mode for allowing heat transfer liquid from the hot conduit to enter into the thermal energy consumer heat exchanger.

The act of selectively setting the flow controller in the pumping mode or in the flowing mode may comprise:

in case $\Delta p1$ is indicative of that a consumer assembly local pressure of heat transfer liquid in the hot conduit is lower than a consumer assembly local pressure of heat transfer liquid in the cold conduit, setting the flow controller in the pumping mode;

in case $\Delta p1$ is indicative of that the consumer assembly local pressure of heat transfer liquid in the hot conduit is higher than the consumer assembly local pressure of heat transfer liquid in the cold conduit, setting the flow controller in the flowing mode.

According to a fifth aspect a method for controlling a thermal energy generator heat exchanger being, via a flow controller, connected to a cold conduit configured to allow heat transfer liquid of a second temperature to flow therethrough, and being, via a return conduit, connected to a hot conduit configured to allow heat transfer liquid of a first temperature to flow therethrough, wherein the second temperature is lower than the first temperature, wherein the flow controller comprises a mode controller configured to selectively set the flow controller in a pumping mode or in a flowing mode, wherein upon set in the pumping mode the flow controller is configured to act as a pump for pumping heat transfer liquid from the cold conduit into the thermal energy generator heat exchanger, and wherein upon set in flowing mode the flow controller is configured to act as a flow regulator for allowing heat transfer liquid from the cold conduit to flow into the thermal energy generator heat exchanger, is provided. The method comprising:

determining a generator assembly local pressure difference, $\Delta p2$, between heat transfer liquid of the hot conduit and heat transfer liquid of the cold conduit; and based on Δp2 selectively setting the flow controller in the pumping mode or in the flowing mode for allowing heat transfer liquid from the cold conduit to enter into the thermal energy generator heat exchanger.

The act of selectively setting the flow controller in the pumping mode or in the flowing mode may comprise:

in case Δp2 is indicative of that a generator assembly local pressure of heat transfer liquid in the cold conduit is lower than a generator assembly local pressure of heat transfer liquid in the hot conduit, setting the flow controller in the pumping mode;

in case Δp2 is indicative of that the generator assembly local pressure of heat transfer liquid in the cold conduit is higher than the generator assembly local pressure of heat transfer liquid in the hot conduit, setting the flow controller in the flowing mode.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claim, the articles "a," "an," "the," and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

These and other aspects of the present invention will now be described in more detail, with reference to the appended drawings showing embodiments of the invention. The figures are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and to fully convey the scope of the invention to the skilled person.

Figure 1:
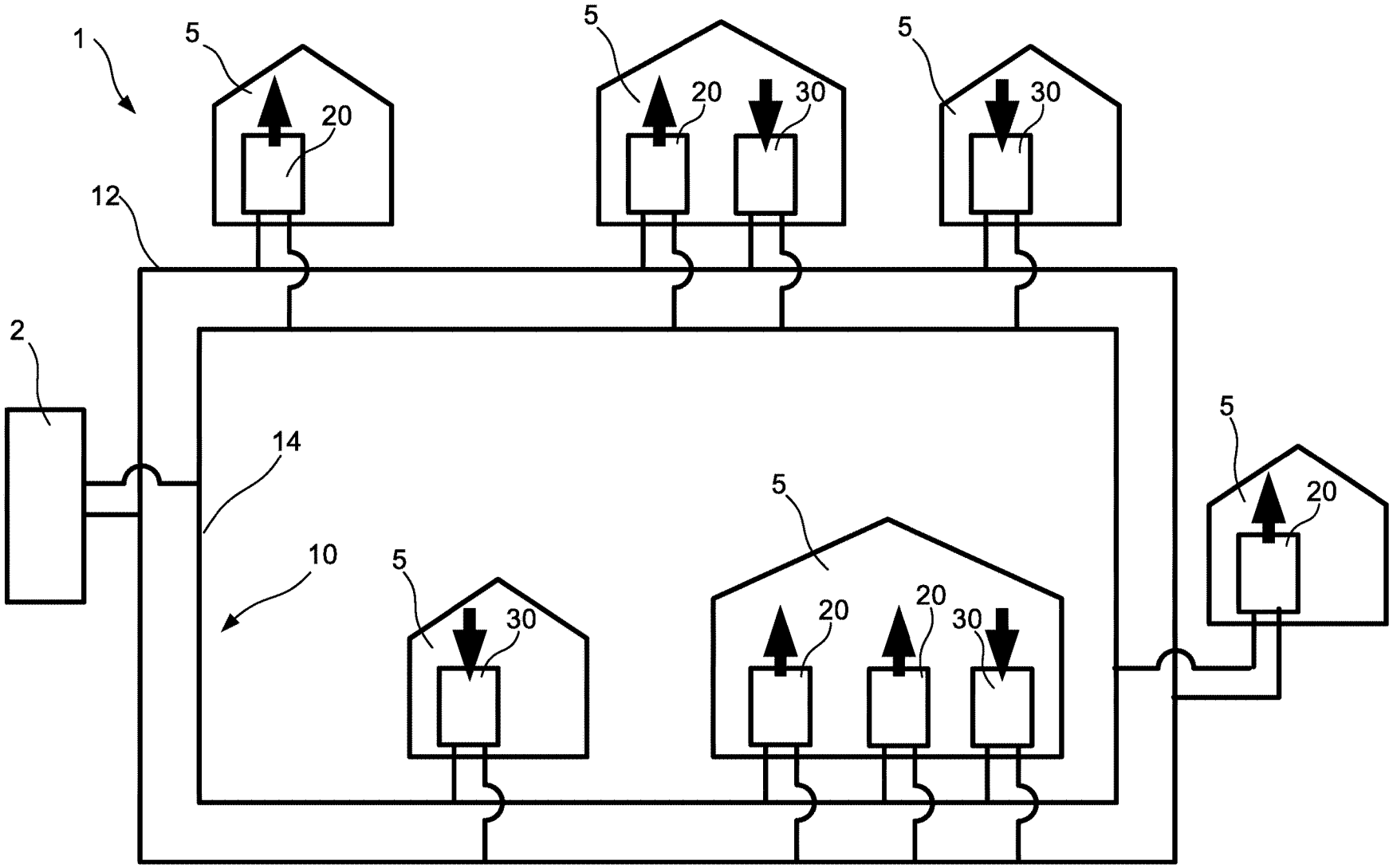
FIG. 1 is a schematic diagram of a district thermal energy distribution system.

In FIG. 1 a district thermal energy distribution system 1 is illustrated. The district thermal energy distribution system 1 comprises a thermal energy circuit 10 and a plurality of buildings 5. The plurality of buildings 5 are thermally coupled to the thermal energy circuit 10. The thermal energy circuit 10 is arranged to circulate and store thermal energy in heat transfer liquid flowing through the thermal energy circuit 10.

The heat transfer liquid may comprise water. However, other heat transfer liquids may alternatively be used. Some non-limiting examples are ammonia, oils, alcohols and anti-freezing liquids, such as glycol. The heat transfer liquid may also comprise a mixture of two or more of the heat transfer liquids mentioned above. A specific mixture to be used is water mixed with an anti-freezing liquid.

The thermal energy circuit 10 comprises two conduits 12, 14 for allowing flow of heat transfer liquid therethrough. The temperature of the heat transfer liquid of the two conduits 12, 14 is set to be different. A hot conduit 12 in the thermal energy circuit 10 is configured to allow heat transfer liquid of a first temperature to flow therethrough. A cold conduit 14 in the thermal energy circuit 10 is configured to allow heat transfer liquid of a second temperature to flow therethrough. The second temperature is lower than the first temperature.

In case heat transfer liquid is water (possibly with added anti-freezing liquid), a suitable temperature range for the hot heat transfer liquid is between 5 and 45° C. and a suitable temperature range for the cold heat transfer liquid is between 0 and 40° C. A suitable temperature difference between the first and second temperatures is in the range of 5-16° C., preferably in the range of 7-12° C., more preferably 8-10° C.

Preferably, the system is set to operate with a sliding temperature difference which varies depending on the climate. Preferably, the sliding temperature difference is fixed. Hence, the temperature difference may be to momentarily slide with a fixed temperature difference.

The hot conduit 12 and the cool conduit 14 are separate. The hot conduit 12 and the cool conduit 14 may be parallelly arranged. The hot conduit 12 and the cool conduit 14 may be arranged as closed loops of piping. The hot conduit 12 and the cool conduit 14 are fluidly interconnected at the buildings 5 for allowing of thermal energy transfer to and from the buildings 5. This will be discussed more in detail further below.

The two conduits 12, 14 of the thermal energy circuit 10 may be formed by plastic, composite, concrete, or metal pipes. According to one embodiment High Density Polyethylene (HDPE) pipes may be used. The pipes may be single wall pipes. The pipes may be un-insulated. According to one embodiment the thermal energy circuit 10 is mainly arranged in the ground. The ground will be used as thermal inertia of the thermal energy circuit 10. Hence, insulation of the piping gives no extra value. Exceptions are installation in cities with a very warm climate or cities with very cold climate. Here the inertia of the ground may be more harmful than good during critical parts of the year. Here insulation of the piping may be needed.

According to one embodiment the two conduits 12, 14 of the thermal energy circuit 10 are dimensioned for pressures up to 1 MPa (10 bar). According to other embodiments the two conduits 12, 14 of the thermal energy circuit 10 may be dimensioned for pressures up to 0.6 MPa (6 bar) or for pressures up to 1.6 MPa (16 bar).

A building 5 comprise at least one of one or more local thermal energy consumer assemblies 20 and one or more local thermal energy generator assemblies 30. Hence, a building comprises at least one local thermal energy consumer assembly 20 or at least one local thermal energy generator assembly 30. One specific building 5 may comprise more than one local thermal energy consumer assembly 20. One specific building 5 may comprise more than one local thermal energy generator assembly 30. One specific building 5 may comprise both a local thermal energy consumer assembly 20 and a local thermal energy generator assembly 30.

The local thermal energy consumer assembly 20 is acting as a thermal sink. Hence, the local thermal energy consumer assembly 20 is arranged to remove thermal energy from the thermal energy circuit 10. Or in other words, the local thermal energy consumer assembly 20 is arranged to transfer thermal energy from heat transfer liquid of the thermal energy circuit 10 to surroundings of the local thermal energy consumer assembly 20. This is achieved by transfer thermal energy from heat transfer liquid taken from the hot conduit 12 to surroundings of the local thermal energy consumer assembly 20, such that heat transfer liquid returned to the cold conduit 14 has a temperature lower than the first temperature and preferably a temperature equal to the second temperature.

The local thermal energy generator assembly 30 is acting as a thermal source. Hence, the local thermal energy generator assembly 30 is arranged to deposit thermal energy to the thermal energy circuit 10. Or in other words, the local thermal energy generator assembly 30 is arranged to transfer thermal energy from its surroundings to heat transfer liquid of the thermal energy circuit 10. This is achieved by transfer thermal energy from surroundings of the local thermal energy generator assembly 30 to heat transfer liquid taken from the cold conduit 12, such that heat transfer liquid returned to the hot conduit 12 has a temperature higher than the second temperature and preferably a temperature equal to the first temperature.

The one or more local thermal energy consumer assemblies 20 may be installed in the buildings 5 as local heaters for different heating needs. As a non-limiting example, a local heater may be arranged to deliver space heating or hot tap hot water preparation. Alternatively or in combination, the local heater may deliver pool heating or ice- and snow purging. Hence, the local thermal energy consumer assembly 20 is arranged for deriving heat from heat transfer liquid of the hot conduit 12 and creates a cooled heat transfer liquid flow into the cold conduit 14. Hence, the local thermal energy consumer assembly 20 fluidly interconnects the hot and cool conduits 12, 14 such that hot heat transfer liquid can flow from the hot conduit 12 through the local thermal energy consumer assembly 20 and then into the cool conduit 14 after thermal energy in the heat transfer liquid has been consumed by the local thermal energy consumer assembly 20. The local thermal energy consumer assembly 20 operates to draw thermal energy from the hot conduit 12 to heat the building 5 and then deposits the cooled heat transfer liquid into the cool conduit 14.

The one or more local thermal energy generator assemblies 30 may be installed in different buildings 5 as local coolers for different cooling needs. As an on-limiting example a local cooler may be arranged to deliver space cooling or cooling for freezers and refrigerators. Alternatively or in combination, the local cooler may deliver cooling for ice rinks and ski centers or ice- and snow making. Hence, the local thermal energy generator assembly 30 is deriving cooling from heat transfer liquid of the cold conduit 14 and creates a heated heat transfer liquid flow into the hot conduit 12. Hence, the local thermal energy generator assembly 30 fluidly interconnects the cold and hot conduits 14, 12 such that cold heat transfer liquid can flow from the cold conduit 14 through the local thermal energy generator assembly 30 and then into the hot conduit 12 after thermal energy has been generated into the heat transfer liquid by the local thermal energy generator assembly 30. The local thermal energy generator assembly 30 operates to extract heat from the building 5 to cool the building 5 and deposits that extracted heat into the hot conduit 12.

Figure 2:
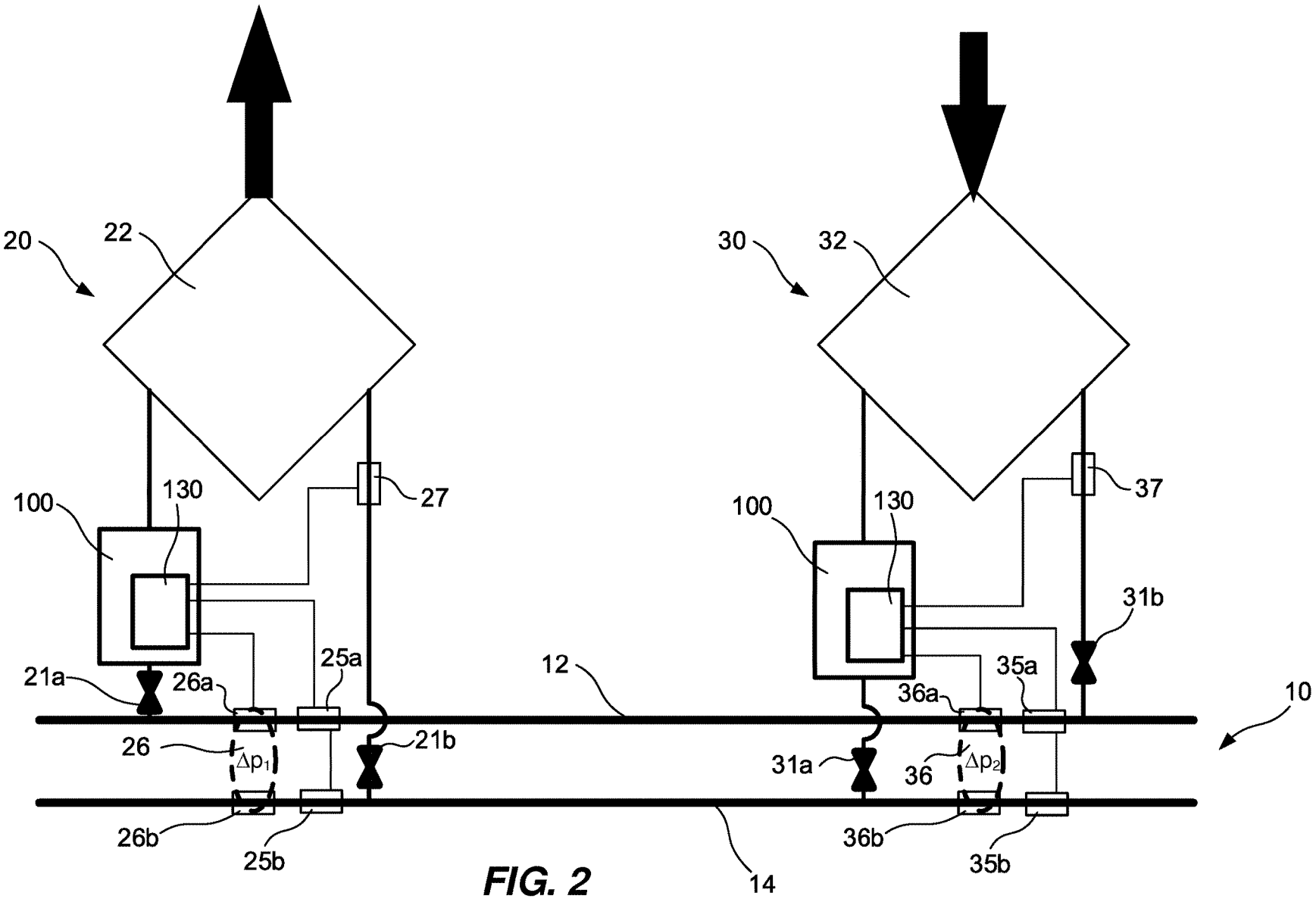
FIG. 2 is a schematic diagram of a local thermal energy consumer assembly and a local thermal energy generator assembly connected to a thermal energy circuit.

With reference to FIG. 2 the function of the local thermal energy consumer assembly 20 and the local thermal energy generator assembly 30 will now be discussed. In FIG. 2 one local thermal energy consumer assembly 20 and one local thermal energy generator assembly 30 are connected to the thermal energy circuit 10. Of course there might be more local thermal energy consumer assemblies or local thermal energy generator assemblies connected to the thermal energy circuit 10.

The local thermal energy consumer assembly 20 comprises a thermal energy consumer heat exchanger 22, a flow controller 100, and a consumer assembly pressure difference determining device 26.

The consumer assembly pressure difference determining device 26 is adapted to determine a consumer assembly local pressure difference, Δp1, of the thermal energy circuit 10. Δp1 is preferably measured in the vicinity to where the thermal energy consumer heat exchanger 22 is connected to the thermal energy circuit 10. The consumer assembly pressure difference determining device 26 may comprises a hot conduit pressure determining device 26*a* and a cold conduit pressure determining device 26*b*. The hot conduit pressure determining device 26*a* is arranged to be connected to the hot conduit 12 for measuring a consumer assembly local pressure, pin, of heat transfer liquid of the hot conduit 12. The cold conduit pressure determining device 26*b* is arranged to be connected to the cold conduit 14 for measuring a consumer assembly local pressure, plc, of heat transfer liquid of the cold conduit 14. The consumer assembly local pressure difference device 26 is arranged to determine the consumer assembly local pressure difference as a pressure difference between the consumer assembly local pressure of heat transfer liquid of the hot conduit 12 and the consumer assembly local pressure of heat transfer liquid of the cold conduit 14. The consumer assembly local pressure difference, Δp1, may hence be expressed as:

$$\Delta p_1 = p_{1c} - p_{1h}.$$

Preferably, the consumer assembly local pressure of heat transfer liquid of the hot conduit 12 is measured in the vicinity to where the thermal energy consumer heat exchanger 22 is connected to the hot conduit 12. Preferably, the consumer assembly local pressure of heat transfer liquid of the cold conduit 14 is measured in the vicinity to where the thermal energy consumer heat exchanger 22 is connected to the cold conduit 14.

The consumer assembly pressure difference determining device 26 may be implemented as a hardware device, a software device, or as a combination thereof. The consumer assembly pressure difference determining device 26 is arranged to generate a signal indicative of the consumer assembly local pressure difference, $\Delta p_t$.

The thermal energy consumer heat exchanger 22 is configured to be connected to the hot conduit 12 via the flow controller 100. The flow controller 100 is selectively set in a pumping mode or in a flowing mode. The flow controller 100 is selectively set in the pumping mode or in the flowing mode based on a consumer assembly local delivery differential pressure, $\Delta p_{1dp}$, $$\Delta p_{1dp}=p_{1c}-p_{1h}+\Delta p_{che}$$

wherein $\Delta P_{che}$ is a differential pressure for overcoming the pressure drop over the thermal energy consumer heat exchanger 22. This will be discussed in more detail below in connection with the more detailed disclosure of the flow controller 100 and in connection with the control of the local thermal energy consumer assembly 20.

Upon set in the pumping mode the flow controller 100 is configured to act as a pump for pumping heat transfer liquid from the hot conduit 12 into the thermal energy consumer heat exchanger 22. Hence, upon the flow controller 100 being set in the pumping mode, heat transfer liquid from the hot conduit 12 is pumped into the thermal energy consumer heat exchanger 22. Upon set in flowing mode the flow controller 100 is configured to act as a flow regulator for allowing heat transfer liquid from the hot conduit 12 to flow into the thermal energy consumer heat exchanger 22. Hence, upon the flow controller 100 being set in the flowing mode, heat transfer liquid from the hot conduit 12 is allowed to flow into the thermal energy consumer heat exchanger 22. Again, the choice of allowing heat transfer liquid from the hot conduit 12 to flow into the thermal energy consumer heat exchanger 22 or pumping heat transfer liquid from the hot conduit 12 into the thermal energy consumer heat exchanger 22, is made based on the consumer assembly local delivery differential pressure, $\Delta p_{1dp}$.

Figure 3:
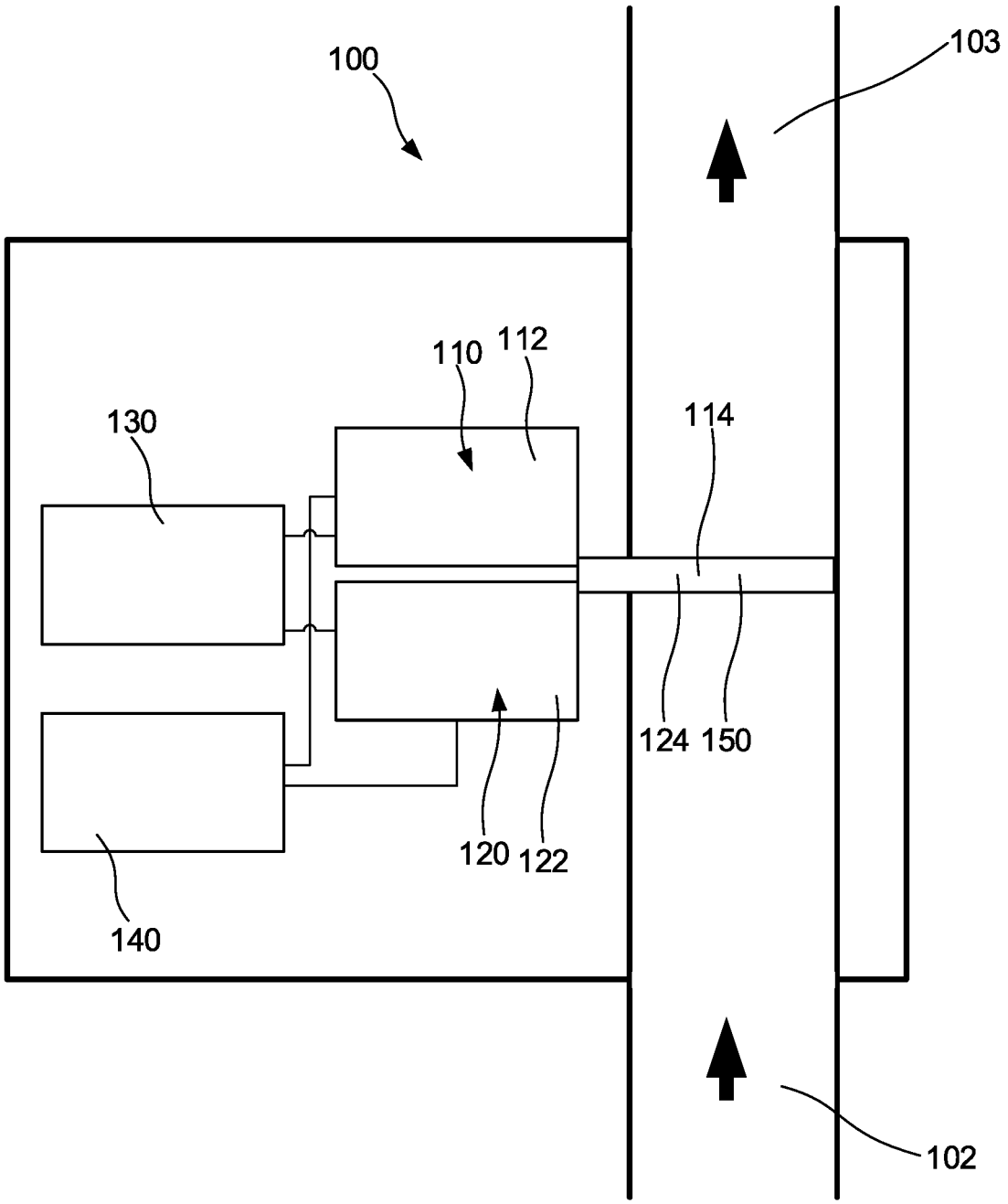
FIG. 3 is a schematic illustration of a flow controller.
Figure 4A:
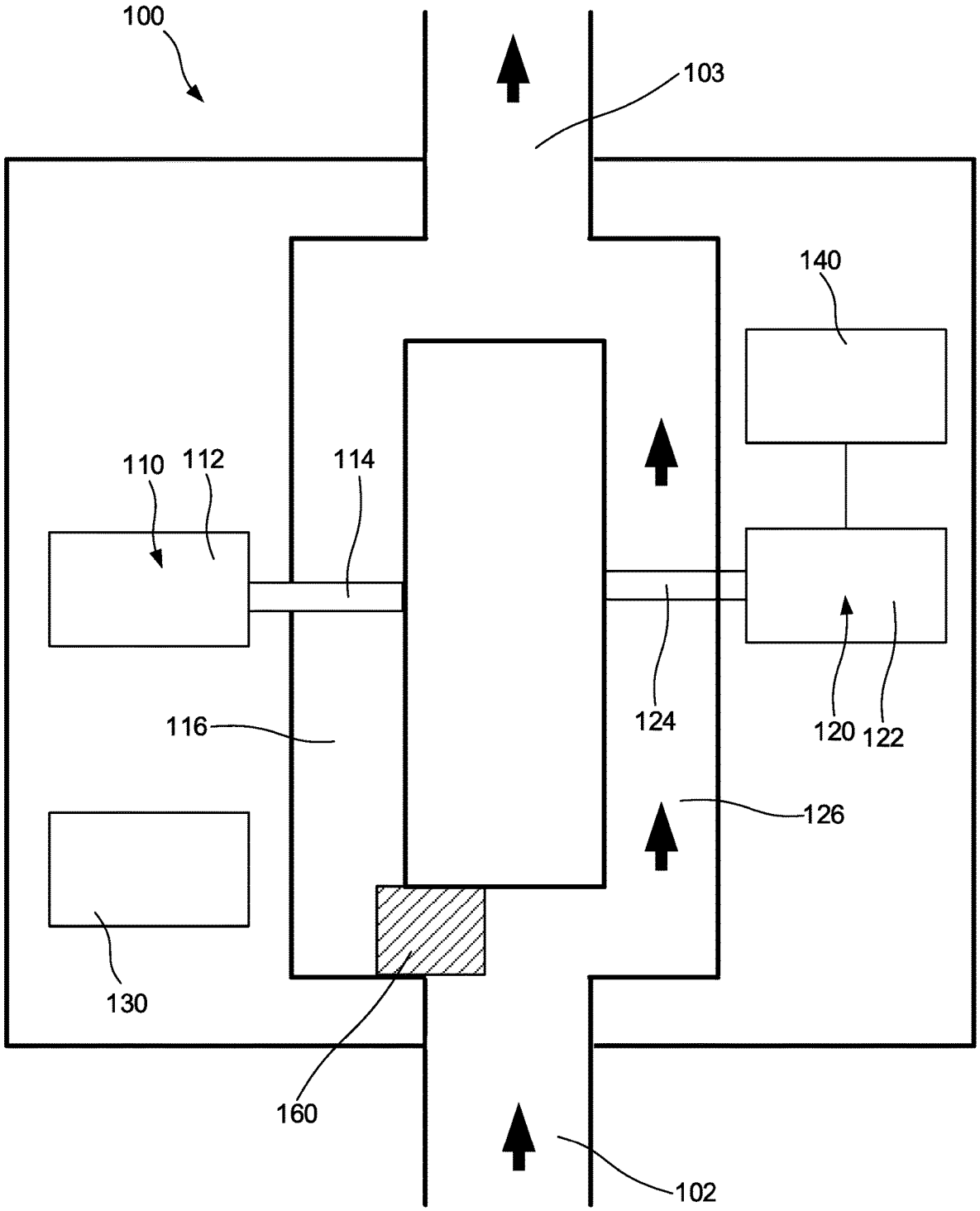
FIG. 4A is a schematic illustration of an alternative flow controller set in a flowing mode.
Figure 4B:
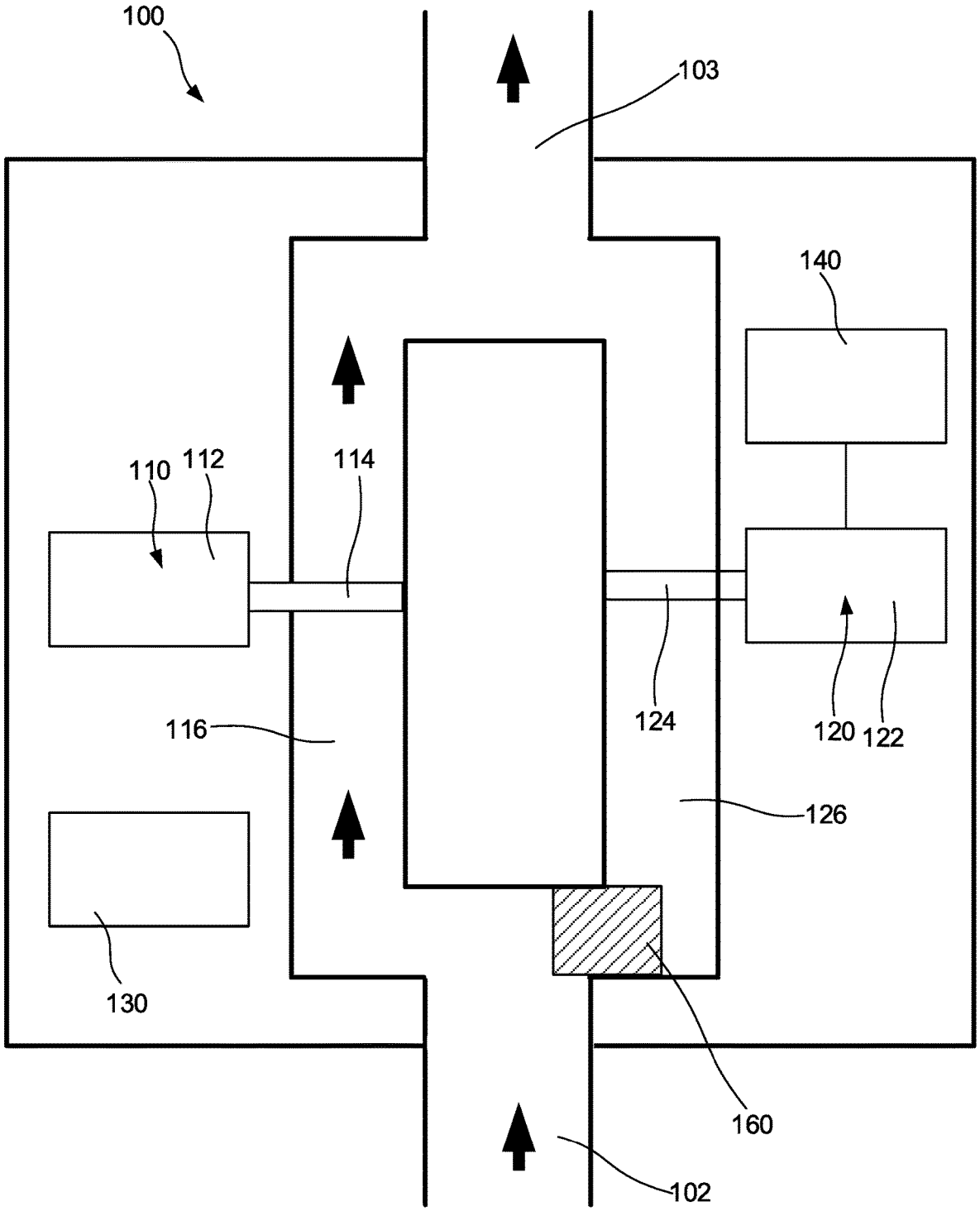
FIG. 4B is a schematic illustration of the alternative flow controller of FIG. 4A set in a pumping mode.

With reference to FIGS. 3, 4*a* and 4*b* embodiments of the flow controller 100 will now be described in greater detail. In FIG. 3 an embodiment of the flow controller 100 is schematically illustrated. In FIGS. 4A and 4B an alternative embodiment of the flow controller 100 is schematically illustrated.

Below first common features of both the flow controller 100 as illustrated in FIG. 3 and the alternative flow controller 100 as illustrated in FIGS. 4A and 4B will be discussed. Thereafter specific features of the two alternative flow controllers 100 will be discussed.

The flow controller 100 comprises an inlet 102 for heat transfer liquid, an outlet 103 for heat transfer liquid, a pump assembly 110 arranged between the inlet 102 and the outlet 103, a flow regulator assembly 120 arranged between the inlet 102 and the outlet 103, and a mode controller 130.

In may be said that the flow controller 100 is configured to be connected in between a first and a second reservoir of fluid. The inlet 102 is configured to be connected to the first reservoir. The outlet 103 is configured to be connected to the second reservoir.

The pump assembly 110, upon being active, is configured to pump heat transfer liquid through the flow controller 100 from the inlet 102 to the outlet 103. The pump assembly 110 may comprise a pumping wheel 114 and an electric motor 112. The electric motor 112 is configured to, upon the pump assembly 110 being active, turn the pumping wheel 114 and thereby inducing pumping action to the pump assembly 110. Hence, the pump wheel 114 of the pump assembly 110 is configured to provide pump action. Moreover, the pump assembly 110 may also be arranged such that the flow rate of heat transfer liquid through the flow controller 100 may be controlled.

The flow regulator assembly 120, upon being active, is configured to allow heat transfer liquid to flow through the flow controller 100 from the inlet 102 to the outlet 103. Moreover, upon being active, the flow regulator assembly 120 is further configured to be selectively set in an electricity generating mode or in a flow decreasing mode.

Upon being set in the electricity generating mode the flow regulator assembly 120 is configured to generate electricity by transforming flow energy of heat transfer liquid flowing through the flow controller 100 into electricity. The flow regulator assembly 120 may comprise a turbine wheel 124 to provide hydro electrical generation and a generator 122 configured to be connected to the turbine wheel 124. The generator 122 is configured to generate electricity upon the turbine wheel 124 being turned. The turbine wheel 124 being turned by a flow of heat transfer liquid flowing through the flow controller 100 upon the flow regulator assembly 120 being set in the electricity generating mode. Hence, the turbine wheel 124 of the flow regulator assembly 120 is configured to provide hydro electrical generation.

As mentioned above, the flow regulator assembly 120 may additionally be set in a flow decreasing mode. Upon the flow regulator assembly 120 being set in the flow decreasing mode, the flow through the flow controller 100 may be regulated by driving the turbine wheel 124, now acting as a deaccelerating means, so that the wheel 124 is rotating against the fluid flow direction. The wheel 124 may be rotated at a predetermined frequency. By rotating the wheel 124 against the fluid flow direction the flow of fluid through the flow controller may be slowed down. Different predetermined frequencies correspond to different flows through the flow controller 100. Hence, the flow through flow controller 100 may be deaccelerated by rotating the wheel 124 against the direction of flow through the flow controller 100.

The mode controller 130 is configured to selectively set the flow controller 100 in the pumping mode or in the flowing mode. The flowing mode comprising two alternative modes, an electricity generating mode and a flow decreasing mode. In the pumping mode the flow controller 100 is acting as a pump. In the flowing mode the flow controller 100 is acting as a flow regulator. In the electricity generating mode the flow regulator 100 is acting as a flow regulator and at the same time as a generator for electricity. In the flow decreasing mode the flow regulator 100 is acting as a flow regulator and at the same time slowing down the flow of fluid through the flow controller 100. Hence, the flow controller 100 is configured to selectively act as a pump or as a flow regulator. The flow controller 100 is configured to, upon acting as a pump, pump heat transfer liquid through the flow controller 100. The flow controller 100 is configured to, upon acting as a flow regulator, allow heat transfer liquid to flow through the flow controller 100. Upon being set in the pumping mode, the mode controller 130 is configured to deactivate the flow regulator assembly 120 and to activate the pump assembly 110. Upon being set in the flowing mode, the mode controller 130 is configured to deactivate the pump assembly 110 and to activate the flow regulator assembly 120.

In the present thermal energy circuit 10 a differential pressure between heat transfer liquid in hot and cold conduits 12, 14 changes over time. More precisely, the differential pressure between heat transfer liquid of the hot and cold conduits 12, 14 may change such that the differential pressure changes from positive to negative or vice versa.

In case the flow controller 100 is comprised in the local thermal energy consumer assembly 20, see above, heat transfer liquid is to be transferred from the hot conduit 12 to the cold conduit 14. Depending on the variating differential pressure between the hot and cold conduits 12, 14 of the thermal energy circuit 10 sometimes heat transfer liquid need to be pumped from the hot conduit 12 to the cold conduit 14 and sometimes heat transfer liquid need to be allowed to flow from hot conduit 12 to the cold conduit 14. More precisely, in case the consumer assembly local delivery differential pressure, $\Delta p_{1dp}$, is negative the flow controller 100 is configured to allow a flow of heat transfer liquid to flow through the flow controller 100. Hence, the mode controller 130 is configured to set the flow controller 100 in the flowing mode. Further, the consumer assembly local delivery differential pressure, $\Delta p_{1dp}$, is positive the flow controller 100 is configured to pump a flow of heat transfer liquid from the hot conduit 12 to the cold conduit 14. Hence, the mode controller 130 is configured to set the flow controller 100 in the pumping mode.

Further, in case the flow controller 100 is comprised in the local thermal energy generator assembly 30, see below, heat transfer liquid is to be transferred from the cold conduit 14 to the hot conduit 12. Depending on the variating differential pressure between the hot and cold conduits 12, 14 of the thermal energy circuit 10 sometimes heat transfer liquid need to be pumped from the cold conduit 14 to the hot conduit 12 and sometimes heat transfer liquid need to be allowed to flow from cold conduit 14 to the hot conduit 12. More precisely, in case a generator assembly local delivery differential pressure, $\Delta p_{2dp}$, (see below for more detail on the generator assembly local delivery differential pressure) is positive the flow controller 100 is configured to allow a flow of heat transfer liquid to flow through the flow controller 100. Hence, the mode controller 130 is configured to set the flow controller 100 in the flowing mode. Further, the generator assembly local delivery differential pressure, $\Delta p_{2dp}$, is negative the flow controller 100 is configured to pump a flow of heat transfer liquid from the cold conduit 14 to the hot conduit 12. Hence, the mode controller 130 is configured to set the flow controller 100 in the pumping mode.

The mode controller 130 is configured to receive a signal indicative on a pressure difference between heat transfer liquid of the hot and cold conduits 12, 14. The mode controller 130 may be fully hardware implemented. Alternatively, the mode controller 130 may be fully software implemented. Yet alternatively, the mode controller 130 may be a combined hardware and software implementation. The software portions of the mode controller 130 may be run on a processing unit. The mode controller 130 is configured to set the flow controller 100 in the pumping mode or the flowing mode based on the signal indicative on the pressure difference between heat transfer liquid in the hot and cold conduits 12, 14.

The mode controller 130 may be configured to set the flow controller 100 in the pumping mode, or the electricity generating mode, or the flow decreasing mode based on a signal indicative on the pressure difference between the fluid at the inlet 102 and the fluid at the outlet 103. If so, the mode controller 130 is configured to set the flow controller 100 in the pumping mode in case the signal is indicative of that the pressure of the fluid at the inlet 102 is equal or lower than the pressure at the outlet 103. Moreover, if so, the mode controller 130 is configured to set the flow controller 100 in the electricity generating mode or in the flow decreasing mode in case the signal is indicative of that the pressure of the fluid at the inlet 2 is higher than the pressure at the outlet 103. The choice of setting the flow controller in the electricity generating mode or in the flow decreasing mode is based on a pressure difference between a pressure of the fluid at the inlet 102 and a pressure of the fluid at the outlet 103. For relatively low pressure differences the mode controller 130 is configured to set the flow controller 100 in the electricity generating mode and for relatively low pressure differences the mode controller 130 is configured to set the flow controller in the flow decreasing mode. The value at which the flow decreasing mode is to chosen instead of the electricity generating mode depend on the actual flow rate through the flow controller 100. In case of the flow rate need to be decreased due to the relatively high pressure difference the mode controller 130 is configured to set the flow controller 100 in the flow decreasing mode.

The mode controller 130 may also be configured to control the flow rate of heat transfer liquid through the flow controller 100. Accordingly, the mode controller 130 may also be configured to control the pump assembly 110 such that the flow rate of heat transfer liquid pumped by the pump assembly 110 is controlled. This may be done by regulating a rotation frequency of a pump wheel 114 of the pump assembly 100. Moreover, the mode controller 130 may also be configured to control the flow regulator assembly 120 such that the flow rate of heat transfer liquid flowing through the flow regulator assembly 120 is controlled. This may be done, as have been discussed above, by regulating the rotation frequency of the wheel 124

With reference to FIG. 3 the flow controller 100 may further comprise a wheel 150. The wheel 150 is selectively operable as the pump wheel 114 of the pump assembly 110 and as a turbine wheel 124 of the flow regulator assembly 120. Upon the flow controller 100 is set in the pumping mode the wheel 150 is selectively operable as the pump wheel 114. Upon the flow controller 100 is set in the flowing mode the wheel 150 is selectively operable as the turbine wheel 124. Upon the flow controller 100 is set in the flow decreasing mode the wheel 150 is selectively operable as a deaccelerating means. Hence, in the pumping mode the wheel 150 is acting as the pumping wheel 124 and is configured to be connected to the electric motor 112. Moreover, in the flowing mode the wheel 150 is acting as the turbine wheel 124 and is configured to be connected to the generator 122. Furthermore, in the flow decreasing mode the wheel 150 is acting as a deaccelerating means and is configured to be connected to the electric motor 112.

With reference to FIGS. 4A and 4B the flow controller 100 may comprise a first flow channel 116 for heat transfer liquid and a second flow channel 126 for heat transfer liquid. The first flow channel 116 forming part of the pump assembly 1110. The second flow channel 126 forming part of the flow regulator assembly 120. The flow controller 100 may further comprise a flow director 160. The flow director 160 is configured to be controlled by the mode controller 130. Upon the flow controller 100 is set in the pumping mode, the flow director 160 is configured to direct flow of heat transfer liquid through the first flow channel 116 and block flow of heat transfer liquid through the second channel 126. This is illustrated in FIG. 4B. Upon the flow controller 100 is set in the flowing mode, the flow director 160 is configured to direct flow of heat transfer liquid through the second flow channel 126 and block flow of heat transfer liquid through the first channel 116. This is illustrated in FIG. 4A. The flow director 160 may be embodied in many different ways. According to a non-limiting example, the flow director 160 may comprise a sliding block configured to selectively block flow of heat transfer liquid through the first and second flow channels 116, 126, respectively. Upon the sliding block of the flow director 160 is blocking one of the first and second flow channels 116, 126 the other one is opened allowing heat transfer liquid to flow therethrough.

The thermal energy consumer heat exchanger 22 is further connected to the cold conduit 14 for allowing return of heat transfer liquid from the thermal energy consumer heat exchanger 22 to the cold conduit 14.

The thermal energy consumer heat exchanger 22 is arranged to transfer thermal energy from heat transfer liquid to surroundings of the thermal energy consumer heat exchanger 22. The heat transfer liquid returned to the cold conduit 14 has a temperature lower than the first temperature. Preferably, thermal energy consumer heat exchanger 22 is controlled such that the temperature of the heat transfer liquid returned to the cold conduit 14 is equal to the second temperature.

The local thermal energy consumer assembly 20 may further comprise a pair of consumer assembly service valves 21*a*, 21*b*. The consumer assembly service valves 21*a*, 21*b* may be used for connecting and disconnecting the thermal energy consumer heat exchanger 22 and the flow controller 100 to/from the thermal energy circuit 10.

The local thermal energy consumer assembly 20 may further comprise a consumer assembly hot conduit temperature determining device 25*a* and a consumer assembly cold conduit temperature determining device 25*b*. The consumer assembly hot conduit temperature determining device 25*a* is arranged to be connected to the hot conduit 12 for measuring a consumer assembly local temperature, tin, of heat transfer liquid of the hot conduit 12. The consumer assembly cold conduit temperature determining device 25*b* is arranged to be connected to the cold conduit 14 for measuring a consumer assembly local temperature, $t_{1c}$, of the heat transfer liquid of the cold conduit 14. The consumer assembly hot conduit temperature determining device 25*a* and the consumer assembly cold conduit temperature determining device 25*b* are connected to the flow controller 100 for communicating $t_{1h}$ and $t_{1c}$ thereto.

The local thermal energy consumer assembly 20 may further comprise a consumer assembly outlet temperature determining device 27. The consumer assembly outlet temperature determining device 27 is arranged to be connected to a return conduit connecting the outlet of the thermal energy consumer heat exchanger 22 to the cold conduit 14. The consumer assembly outlet temperature determining device 27 is arranged to measure an outlet temperature, $t_{che}$, of heat transfer liquid exiting the outlet of the thermal energy consumer heat exchanger 22 and being returned to the cold conduit 14. The consumer assembly outlet temperature determining device 27 is connected to the flow controller 100 for communicating $t_{che}$ thereto.

Figure 5:
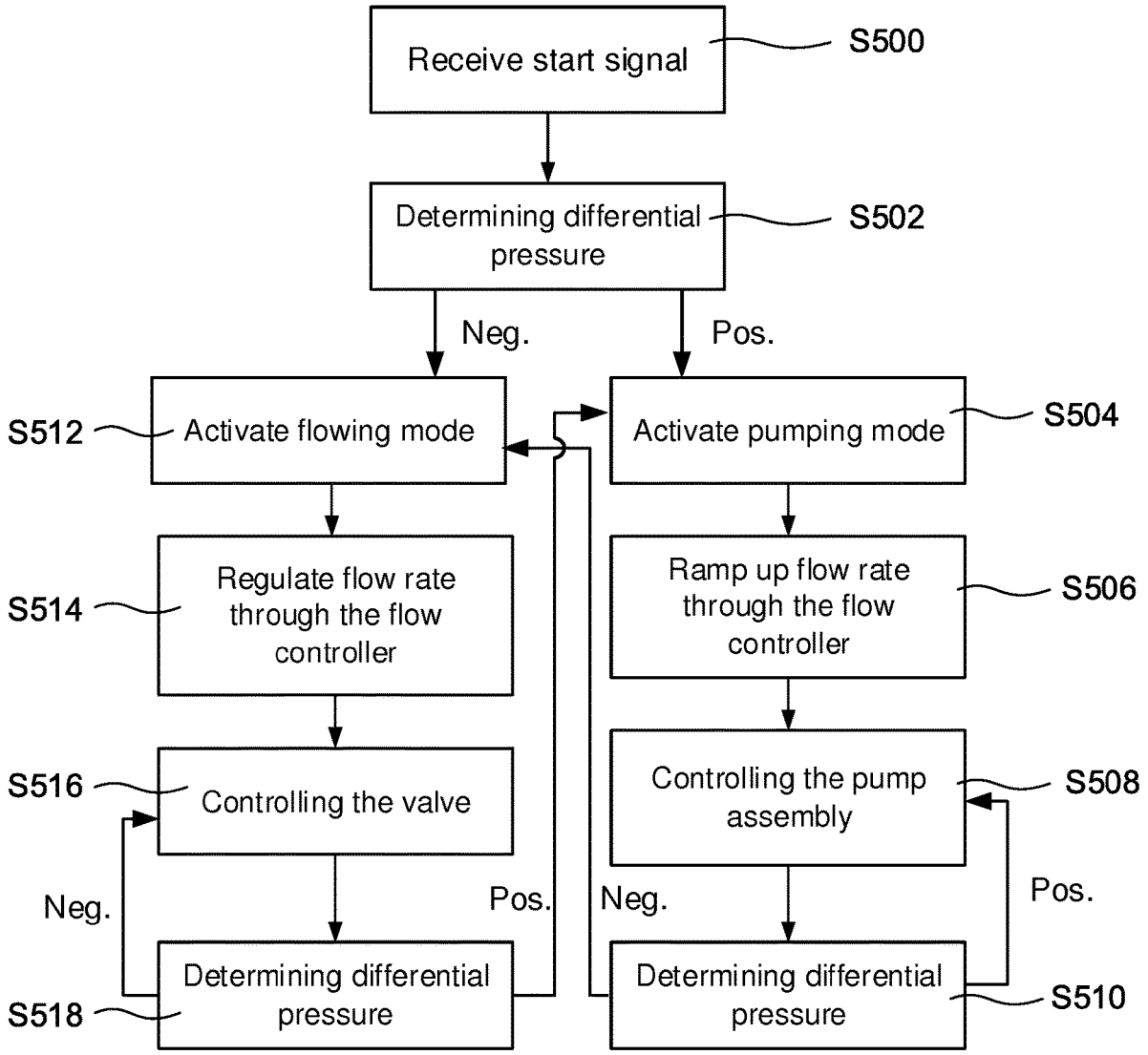
FIG. 5 is a block diagram of controlling of a local thermal energy consumer assembly.

In connection with FIG. 5, an exemplified embodiment on how the mode controller 130 of the flow controller 100 is arranged to control the local thermal energy consumer assembly 20 will be discussed.

Starting of the Local Thermal Energy Consumer Assembly

1. Receiving S500 a start signal by the mode controller 100. The start signal indicating that the local thermal energy consumer assembly 20 shall start working for exhaling thermal energy to its surroundings. The start signal may e.g. be issued by a thermostat (not shown) located in the building wherein the local thermal energy consumer assembly 20 is situated.
2. Determining S502 the consumer assembly local delivery differential pressure, $\Delta p_{1dp}$, according to the following:

$$\Delta p_{1dp}=p_{1c}-p_{1h}+\Delta p_{che}$$

wherein $\Delta p_{che}$ is a differential pressure for overcoming the pressure drop over the thermal energy consumer heat exchanger 22.

3. In case $\Delta p_{1dp}$ is a positive value:
   a. Setting S504 the flow controller 100 in the pumping mode.
   b. Ramping up S506 the flow rate of the pump assembly 110 so that a predetermined flow rate through the thermal energy consumer heat exchanger 22 is achieved.
   c. Switching to normal operation mode of the local thermal energy consumer assembly at pump operation, see below.
4. In case $\Delta p_{1dp}$ is a negative value:
   a. Setting S512 the flow controller 100 in the flowing mode.
   b. Regulating S514 a flow rate through the flow controller 100 so that a predetermined flow rate through the thermal energy consumer heat exchanger 22 is achieved.
   c. Switching to normal operation mode of the local thermal energy consumer assembly at flow operation, see below.

Normal Operation Mode of the Local Thermal Energy Consumer Assembly at Pump Operation 1. Controlling S508 the pump assembly 110 such that the flow rate of heat transfer liquid through the thermal energy consumer heat exchanger 22 is set such that a differential temperature, $\Delta t_{che}=t_{1h}-t_{che}$, over the thermal energy consumer heat exchanger 22 is kept at a predetermined value. A suitable predetermined differential temperature is in the range of 5-16° C., preferably in the range of 7-12° C., more preferably 8-10° C.
2. Determining S510 the consumer assembly local delivery differential pressure, $\Delta p_{1dp}$.
3. In case $\Delta p_{1dp}$ is a positive value; return to point 1. above under "Normal operation mode of the local thermal energy consumer assembly at pump operation".
4. In case $\Delta p_{1dp}$ is a negative value:
   a. Go to point 4, above under "Starting of the local thermal energy consumer assembly".
   b. Stopping the pump assembly 110 by sending a stop signal thereto from the mode controller 130.

Normal Operation Mode of the Local Thermal Energy Consumer Assembly at Flow Operation 1. Controlling S516 the flow regulator assembly 120 such that the flow rate of heat transfer liquid through the thermal energy consumer heat exchanger 22 is set such that the differential temperature, $\Delta t_{che}=t_{1h}-t_{che}$, over the thermal energy consumer heat exchanger 22 is kept at a predetermined value. A suitable predetermined differential temperature is in the range of 5-16° C., preferably in the range of 7-12° C., more preferably 8-10° C.
2. Determining S518 the consumer assembly local delivery differential pressure, $\Delta p_{1dp}$.
3. In case $\Delta p_{1dp}$ is still a negative value; return to point 1. above under "Normal operation mode of the local thermal energy consumer assembly at flow operation".
4. In case $\Delta p_{1dp}$ is a negative value:
   a. Go to point 3, above under "Starting of the local thermal energy consumer assembly".
   b. Stopping the flow regulator assembly 120 by sending a stopping signal thereto from the mode controller 130.

With reference to FIG. 2, the local thermal energy generator assembly 30 comprises a thermal energy generator heat exchanger 32, a flow controller 100, and a generator assembly pressure difference determining device 26.

The generator assembly pressure difference determining device 36 is adapted to determine a generator assembly local pressure difference, $\Delta p_2$, of the thermal energy circuit 10. $\Delta p_2$ is preferably measured in the vicinity to where the thermal energy generator heat exchanger 32 is connected to the thermal energy circuit 10. The generator assembly pressure difference determining device 36 may comprises a hot conduit pressure determining device 36*a* and a cold conduit pressure determining device 36*b*. The hot conduit pressure determining device 36*a* is arranged to be connected to the hot conduit 12 for measuring a generator assembly local pressure, $p_{2h}$, of heat transfer liquid of the hot conduit 12. The cold conduit pressure determining device 36*b* is arranged to be connected to the cold conduit 14 for measuring a generator assembly local pressure, $p_{2c}$, of heat transfer liquid of the cold conduit 14. The generator assembly local pressure difference device 36 is arranged to determine the generator assembly local pressure difference as a pressure difference between the generator assembly local pressure of heat transfer liquid of the hot conduit 12 and the generator assembly local pressure of heat transfer liquid of the cold conduit 14. The generator assembly local pressure difference, $\Delta p_2$, may hence be expressed as:

$$\Delta p_2 = p_{2c} - p_{2h}.$$

Preferably, the generator assembly local pressure of heat transfer liquid of the hot conduit 12 is measured in the vicinity to where the thermal energy generator heat exchanger 32 is connected to the hot conduit 12. Preferably, the generator assembly local pressure of heat transfer liquid of the cold conduit 14 is measured in the vicinity to where the thermal energy generator heat exchanger 32 is connected to the cold conduit 14.

The generator assembly pressure difference determining device 36 may be implemented as a hardware device, a software device, or as a combination thereof. The generator assembly pressure difference determining device 36 is arranged to generate a signal indicative of the generator assembly local pressure difference, $\Delta p_2$.

The thermal energy generator heat exchanger 32 is connected to the cold conduit 14 via the flow controller 100. The flow controller 100 is selectively set in the pumping mode or in the flowing mode. The flow controller 100 is selectively set in the pumping mode or in the flowing mode based on the generator assembly local delivery pressure difference, $\Delta p_{2dp}$, $$\Delta p_{2dp} = p_{2c} - p_{2h} + \Delta p_{ghe}$$

wherein $\Delta P_{ghe}$ is a differential pressure for overcoming the pressure drop over the thermal energy generator heat exchanger 32. This was discussed in more detail in connection with the more detailed disclosure of the flow controller 100 above and will be discussed in even more detail below in connection with the control of the local thermal energy generator assembly 30.

Upon set in the pumping mode the flow controller 100 is configured to act as a pump for pumping heat transfer liquid from the cold conduit 14 into the thermal energy generator heat exchanger 32. Hence, upon the flow controller 100 being set in the pumping mode, heat transfer liquid from the cold conduit 14 is pumped into the thermal energy generator heat exchanger 32. Upon set in flowing mode the flow controller 100 is configured to act as a flow regulator for allowing heat transfer liquid from the cold conduit 14 to flow into the thermal energy generator heat exchanger 32. Hence, upon the flow controller 100 being set in the flowing mode, heat transfer liquid from the cold conduit 14 is allowed to flow into the thermal energy generator heat exchanger 32. Again, the choice of allowing heat transfer liquid from the cold conduit 14 to flow into the thermal energy generator heat exchanger 32 or pumping heat transfer liquid from the cold conduit 14 into the thermal energy generator heat exchanger 32, is made based on the generator assembly local delivery differential pressure, $\Delta p_{2dp}$.

The thermal energy generator heat exchanger 32 is further connected to the hot conduit 12 for allowing return of heat transfer liquid from the thermal energy generator heat exchanger 32 to the hot conduit 12.

The thermal energy generator heat exchanger 32 is arranged to transfer thermal energy from its surroundings to heat transfer liquid. The heat transfer liquid returned to hot conduit 12 has a temperature higher than the second temperature. Preferably, thermal energy generator heat exchanger 32 controlled such that the temperature of the heat transfer liquid returned to the hot conduit 12 is equal to the first temperature.

The local thermal energy generator assembly 30 may further comprise a pair of generator assembly service valves 31*a*, 31*b*. The generator assembly service valves 31*a*, 31*b* may be used for connecting and disconnecting the thermal energy generator heat exchanger 32 and the flow controller 100 to/from the thermal energy circuit 10.

The local thermal energy generator assembly 30 may further comprise a generator assembly hot conduit temperature determining device 35*a* and a generator assembly cold conduit temperature determining device 35*b*. The generator assembly hot conduit temperature determining device is arranged to be connected to the hot conduit 12 for measuring a generator assembly local temperature, $t_{2h}$, of heat transfer liquid of the hot conduit 12. The generator assembly cold conduit temperature determining device is arranged to be connected to the cold conduit 14 for measuring a generator assembly local temperature, $t_{2c}$, of the heat transfer liquid of the cold conduit 14. The generator assembly hot conduit temperature determining device 35*a* and the generator assembly cold conduit temperature determining device 35*b* are connected to the flow controller 100 for communicating $t_{1h}$ and $t_{1c}$ thereto.

The local thermal energy generator assembly 30 may further comprise a generator assembly outlet temperature determining device 37. The generator assembly outlet temperature determining device 37 is arranged to be connected to a return conduit connecting the outlet of the thermal energy generator heat exchanger 32 to the hot conduit 12. The generator assembly outlet temperature determining device 37 is arranged to measure an outlet temperature $t_{ghe}$, of heat transfer liquid exiting the outlet of the thermal energy generator heat exchanger 32 and being returned to the hot conduit 12. The generator assembly outlet temperature determining device 37 is connected to the flow controller 100 for communicating $t_{ghe}$ thereto.

Figure 6:
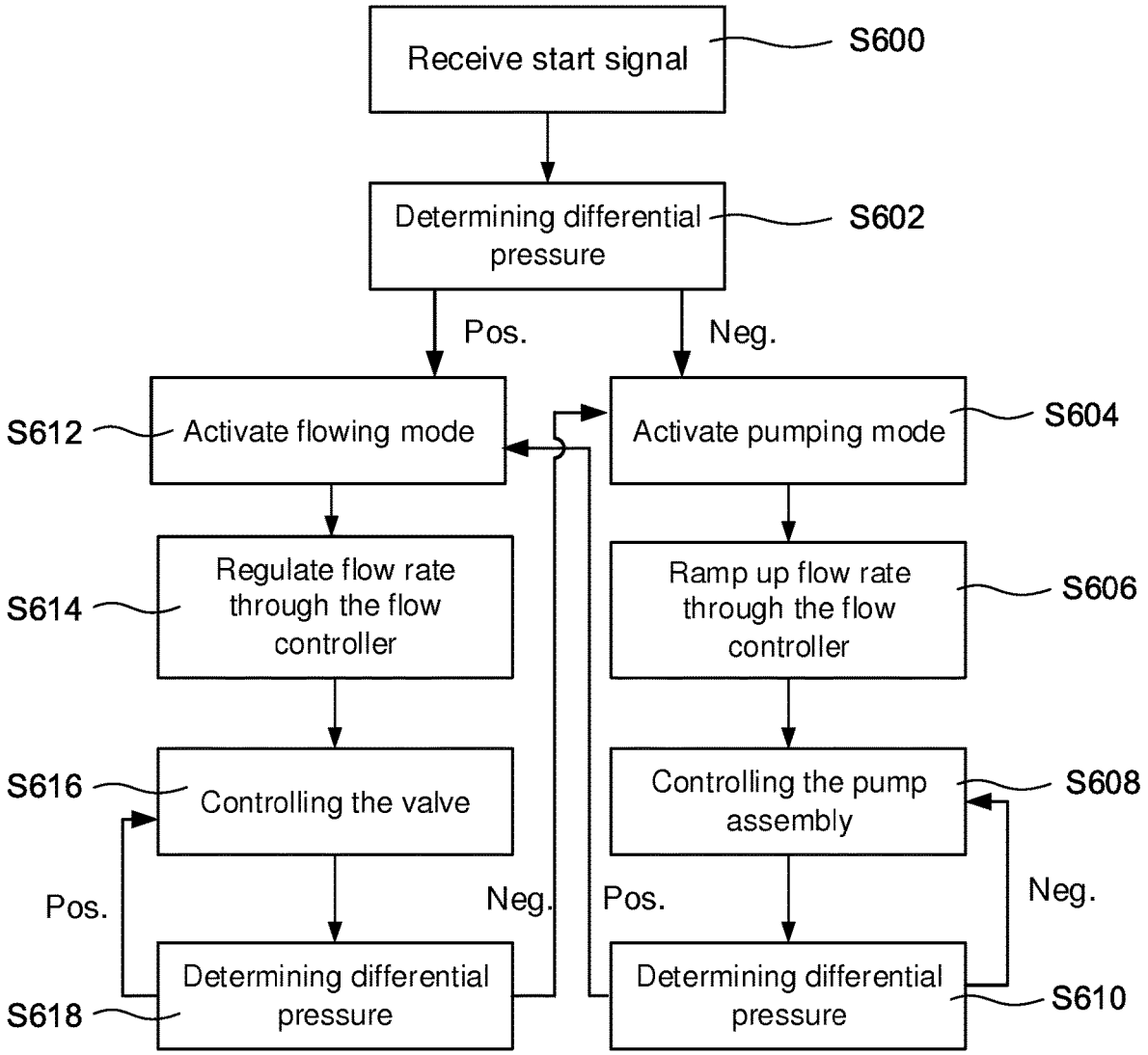
FIG. 6 is a block diagram of controlling of a local thermal energy generator assembly.

In connection with FIG. 6, an exemplified embodiment on how the mode controller 130 of the flow controller 100 is arranged to control the local thermal energy generator assembly 30 will discussed.

Starting of the Local Thermal Energy Generator Assembly

1. Receiving S600 a start signal by the mode controller 130. The start signal indicating that the local thermal energy generator assembly 30 shall start working for inhaling thermal energy from its surroundings. The start signal may e.g. be issued by a thermostat (not shown) located in the building wherein the local thermal energy generator assembly 30 is situated.

2. Determining S602 the generator assembly local delivery differential pressure, $\Delta p_{2dp}$, according to the following:

$$\Delta p_{2dp}=p_{2c}-p_{2h}+\Delta p_{ghe}$$

wherein $\Delta p_{ghe}$ is a differential pressure for overcoming the pressure drop over the thermal energy generator heat exchanger 32.

3. In case $\Delta p_{ghe}$ is a negative value:
   a. Setting S604 the flow controller 100 in the pumping mode.
   b. Ramping up S606 the flow rate of the pump assembly 110 so that a predetermined flow rate through the thermal energy generator heat exchanger 32 is achieved.
   c. Switching to normal operation mode of the local thermal energy generator assembly at pump operation, see below.
4. In case $\Delta p_{2dp}$ is a positive value:
   a. Setting S612 the flow controller 100 in the flowing mode.
   b. Regulating S514 a flow rate through the flow controller 100 so that a predetermined flow rate through the thermal energy generator heat exchanger 32 is achieved.
   c. Switching to normal operation mode of the local thermal energy generator assembly at flow operation, see below.

Normal Operation Mode of the Local Thermal Energy Generator Assembly at Pump Operation 1. Controlling S608 the pump assembly 110 such that the flow rate of heat transfer liquid through the thermal energy generator heat exchanger 32 is set such that a differential temperature, $\Delta t_{ghe}=t_{2h}-t_{ghe}$, over the thermal energy consumer heat exchanger 22 is kept at a predetermined value. A suitable predetermined differential temperature is in the range of 5-16° C., preferably in the range of 7-12° C., more preferably 8-10° C.
2. Determining S610 the generator assembly local delivery differential pressure, $\Delta p_{2dp}$.
3. In case $\Delta p_{2dp}$ is a negative value; return to point 1. above under "Normal operation mode of the local thermal energy generator assembly at pump operation".
4. In case the $\Delta p_{2dp}$ is a positive value:
   a. Go to point 4, above under "Starting of the local thermal energy generator assembly".
   b. Stopping the pump assembly 110 by sending a stop signal thereto from the mode controller 130.

Normal Operation Mode of the Local Thermal Energy Generator Assembly at Flow Operation 1. Controlling S616 the flow regulator assembly 120 such that the flow rate of heat transfer liquid through the thermal energy generator heat exchanger 32 is set such that the differential temperature, $\Delta t_{ghe}=t_{2h}-t_{ghe}$, over the thermal energy generator heat exchanger 32 is kept at a predetermined value. A suitable predetermined differential temperature is in the range of 5-16° C., preferably in the range of 7-12° C., more preferably 8-10° C.
2. Determining S618 the generator assembly local delivery differential pressure, $\Delta p_{2dp}$.
3. In case $\Delta p_{2dp}$ is still a positive value; return to point 1. above under "Normal operation mode of the local thermal energy generator assembly at flow operation".
4. In case $\Delta p_{2dp}$ is a positive value:
   a. Go to point 3, above under "Starting of the local thermal energy generator assembly".
   b. Stopping the flow regulator assembly 120 by sending a stopping signal thereto from the mode controller 130.

Accordingly, a local thermal energy consumer assembly 20 and a local thermal energy generator assembly 30 to be connected to a thermal energy circuit 10 comprising a hot and a cold conduit 12, 14 is provided. The local thermal energy consumer assembly 20 is connected via a flow controller 100 to the hot conduit 12. The local thermal energy generator assembly 30 is connected via a flow controller 100 to the cold conduit 14. The flow controller 100 is selectively set in pumping mode or a flowing mode based on a local pressure difference between heat transfer liquid of the hot and cold conduits 12, 14. Moreover, a district thermal energy distribution system, comprising the hot and the cold conduits 12, 14 is provided. The district thermal energy distribution system also comprises one or more local thermal energy consumer assemblies 20 and/or one or more thermal energy generator assemblies 30.

Accordingly, the district thermal energy distribution system 1 comprises a thermal energy circuit 10 comprising the hot and cold conduit 12, 14 for allowing flow of heat transfer liquid therethrough. The district thermal energy distribution system 1 further comprises one or more thermal energy consumer heat exchangers 22 and one or more thermal energy generator heat exchangers 32. In accordance with what has been disclosed above the district thermal energy distribution system 1 may comprise a thermal energy consumer heat exchanger 22 connected to the hot conduit 12 via a flow controller 100. The flow controller 100 is selectively set in pumping mode or a flowing mode based on the local pressure difference between heat transfer liquid of the hot and cold conduits 12, 14. Alternatively or in addition, the district thermal energy distribution system 1 may comprise a thermal energy consumer heat exchanger 22 selectively connected to the hot conduit 12 via a thermal energy consumer valve (not shown) or a thermal energy consumer pump (not shown). The use of the thermal energy consumer valve or the thermal energy consumer pump for letting heat transfer liquid to flow through the thermal energy consumer heat exchanger 22 is based on the local pressure difference between heat transfer liquid of the hot and cold conduits 12, 14. Further, in accordance with what has been disclosed above the district thermal energy distribution system 1 may comprise a thermal energy generator heat exchanger 32 connected to the cold conduit 14 via a flow controller 100. The flow controller 100 is selectively set in pumping mode or a flowing mode based on the local pressure difference between heat transfer liquid of the hot and cold conduits 12, 14. Alternatively or in addition, the district thermal energy distribution system 1 may comprise a thermal energy generator heat exchanger 32 selectively connected to the cold conduit 14 via a thermal energy generator valve (not shown) or a thermal energy generator pump (not shown). The use of the thermal energy generator valve or the thermal energy generator pump for letting heat transfer liquid to flow through the thermal energy generator heat exchanger 32 is based on the local pressure difference between heat transfer liquid of the hot and cold conduits 12, 14.

Preferably, the demand to inhale or exhale heat using the thermal energy consumer heat exchangers 22 and the thermal energy generator heat exchangers 32 is made at a defined temperature difference. A temperature difference of 8-10° C. corresponds to optimal flows through the thermal energy consumer heat exchangers 22 and the thermal energy generator heat exchangers 32.

The local pressure difference between the hot and cold conduits 12, 14 may vary along the thermal energy circuit 10. Especially, the local pressure difference between the hot and cold conduits 12, 14 may vary from positive to negative pressure difference seen from one of the hot and cold conduits 12, 14. Hence, sometimes a specific local thermal energy consumer/generator assembly 20, 30 may need to pump heat transfer liquid through the corresponding thermal energy consumer/generator heat exchanger 22, 32 and sometimes the specific local thermal energy consumer/generator assembly 20, 20 may need to let heat transfer liquid flow through the corresponding thermal energy consumer/generator heat exchanger 22, 32. Accordingly, it will be possible to let all the pumping within the system 1 to take place in the local thermal energy consumer/generator assemblies 20, 30. Hence, an easy to build district thermal energy distribution system 1 is provided. Further a district thermal energy distribution system 1 that is easy to control is provided. Moreover, due to the limited flows and pressures needed the pump assemblies of the flow controllers 100 may be based on frequency controlled circulation pumps.

The basic idea of the district thermal energy distribution system 1 is based on the insight by the inventors that modern day cities by them self provide thermal energy that may be reused within the city. The reused thermal energy may be picked up by the district thermal energy distribution system 1 and be used for e.g. space heating or hot tap water preparation. Moreover, increasing demand for space cooling will also be handled within the district thermal energy distribution system 1. Within the district thermal energy distribution system 1 buildings 5 within the city are interconnected and may in an easy and simple way redistribute low temperature waste energy for different local demands. Amongst other the district thermal energy distribution system will provide for:

- Minimizing the use of primary energy due to optimal re-use of energy flows inside the city.
- Limiting the need for chimneys or firing places inside the city, since the need for locally burning gas or other fuels will be reduced.
- Limiting the need for cooling towers or cooling convectors inside the city, since excess heat produced by cooling devices may be transported away and reused within the district thermal energy distribution system 1.

Hence, the district thermal energy distribution system 1 provide for a smart duel use of thermal energy within a city. When integrated into a city the district thermal energy distribution system 1 provide make use of low level thermal energy waste in both heating and cooling applications within the city. This will reduce the primary energy consumption of a city by eliminating the need for a gas grid or a district heating grid and a cooling grid in city.

The district thermal energy distribution system 1 may comprise a thermal server plant 2. The thermal server plant 2 functions as an external thermal source and/or thermal sink. The function of the thermal server plant 2 is to maintain the temperature difference between the hot and cold conduits 12, 14 of the thermal energy circuit 10. That is, the thermal server plant 2 may be used for balancing the district thermal energy distribution system 1 such that when the thermal energy circuit 10 reaches a temperature end point the thermal server plant 2 is arranged to inhale or exhale thermal energy to/from the thermal energy circuit 10. In winter time, when there is higher probability that the hot conduit 12 reaches its' lowest temperature end point, the thermal server plant 2 is used for adding thermal energy to the thermal energy circuit 10. In summer time, when there is higher probability that the cold conduit reaches its' highest temperature end point, the thermal server plant 2 is used to subtract thermal energy from the thermal energy circuit 10.

The person skilled in the art realizes that the present invention by no means is limited to the preferred embodiments described above. On the contrary, many modifications and variations are possible within the scope of the appended claims.

For example, the flow controller 100 may further comprise a battery 140. The battery 140 may be configured to store electricity generated by the flow regulator assembly 120 upon being in the electricity generating mode. The electric motor 112 may be configured to at least partly be powered by the electricity stored in the battery 140. The mode controller 130 may at least party be configured to be powered by the electricity stored in the battery 140.

Moreover, the electric motor 112 may be configured to act as the generator 122 upon the flow controller 100 is set in the electricity generating mode. Upon being set in the pumping mode the electric motor 112 is configured to be supplied by electricity. The mode controller 130 may be configured to control the supply of electricity to the electric motor 112. When being applied by electricity the electric motor 112 is configured to turn the wheel 150 now acting as the pumping wheel 114 or as the deaccelerating means. Upon being set in the flowing mode the electric motor 112 may be configured to act as the generator 122. When the electric motor 112 is acting as the generator 122 turning of the wheel 150 now acting as the turbine wheel 114 induce the generator 122 to generate electricity. In accordance with the above, the generated electricity may be stored in the battery 140. The electricity stored in the battery 140 may then later be used for powering the electric motor 112 when being set in the pumping mode or in the flow decreasing mode.

Further, in the in FIG. 2 shown embodiment the pressure difference determining devices 26; 36 are two physically different pressure difference determining devices. However, according to another embodiment one specific local thermal energy consumer assembly 20 and one specific local thermal energy generator assembly 30 may share the same pressure difference determining device. Hence, pressure difference determining devices 26; 36 may physically be the same pressure difference determining device. According to a further embodiment two specific local thermal energy consumer assemblies 20 may share the same pressure difference determining device. According to a yet another embodiment two specific local thermal energy generator assemblies 30 may share the same pressure difference determining device Additionally, variations to the disclosed embodiments can be understood and effected by the skilled person in practicing the claimed invention, from a study of the drawings, the disclosure, and the appended claims.

The invention claimed is:

1. A local thermal energy consumer assembly, arranged to be connected to a thermal energy circuit comprising a hot conduit configured to allow heat transfer liquid of a first temperature to flow therethrough, and a cold conduit configured to allow heat transfer liquid of a second temperature to flow therethrough, the second temperature is lower than the first temperature, the local thermal energy consumer assembly comprising:

a consumer assembly pressure difference determining device adapted to determine a consumer assembly local pressure difference, Δp1, of the thermal energy circuit;

a thermal energy consumer heat exchanger; and a flow controller, wherein the thermal energy consumer heat exchanger is arranged to be connected to the hot conduit via the flow controller, wherein the flow controller comprises a mode controller configured to, based on Δp1, selectively set the flow controller in a pumping mode or in a flowing mode, wherein upon set in the pumping mode the flow controller is configured to act as a pump for pumping heat transfer liquid from the hot conduit into the thermal energy consumer heat exchanger, and wherein upon set in flowing mode the flow controller is configured to act as a flow regulator for allowing heat transfer liquid from the hot conduit to flow into the thermal energy consumer heat exchanger, wherein the thermal energy consumer heat exchanger is further arranged to be connected to the cold conduit for allowing return of heat transfer liquid from the thermal energy consumer heat exchanger to the cold conduit, and wherein the thermal energy consumer heat exchanger is arranged to transfer thermal energy from heat transfer liquid to surroundings of the thermal energy consumer heat exchanger, such that heat transfer liquid returned to the cold conduit has a temperature lower than the first temperature and preferably a temperature equal to the second temperature.

2. The local thermal energy consumer assembly according to claim 1, wherein the mode controller is configured to set the flow controller in the pumping mode in case Δp1 is indicative of that a consumer assembly local pressure of heat transfer liquid in the hot conduit is lower than a consumer assembly local pressure of heat transfer liquid in the cold conduit, and wherein the mode controller is configured to set the flow controller in the flowing mode in case Δp1 is indicative of that the consumer assembly local pressure of heat transfer liquid in the hot conduit is higher than the consumer assembly local pressure of heat transfer liquid in the cold conduit.

3. The local thermal energy consumer assembly according to claim 1, wherein the flow controller further comprises:

an inlet for heat transfer liquid;

an outlet for heat transfer liquid;

a pump assembly arranged between the inlet and the outlet and configured to pump heat transfer liquid through the flow controller from the inlet to the outlet;

a flow regulator assembly arranged between the inlet and the outlet and configured to allow the heat transfer liquid flow through the flow controller from the inlet to the outlet and to generate electricity by transforming flow energy of heat transfer liquid flowing through the flow controller into electricity;

wherein upon being set in the pumping mode, the mode controller is configured to activate the pump assembly and to deactivate the flow regulator assembly;

wherein upon being set in the flowing mode, the mode controller is configured to deactivate the pump assembly and to activate the flow regulator assembly.

4. The local thermal energy consumer assembly according to claim 3, wherein the flow controller further comprises a wheel, wherein the wheel is selectively operable as a pump wheel of the pump assembly to provide pump action upon the flow controller is set in the pumping mode and as a turbine wheel of the flow regulator assembly to provide hydro electrical generation upon the flow controller is set in the flowing mode.

5. The local thermal energy consumer assembly according to claim 3, wherein the flow controller further comprises a first flow channel for the heat transfer liquid and a second flow channel for the heat transfer liquid, wherein the first flow channel forming part of the pump assembly and the second flow channel forming part of the flow regulator assembly.

6. A local thermal energy generator assembly, arranged to be connected to a thermal energy circuit comprising a hot conduit configured to allow heat transfer liquid of a first temperature to flow therethrough, and a cold conduit configured to allow heat transfer liquid of a second temperature to flow therethrough, the second temperature is lower than the first temperature, the local thermal energy generator assembly comprising:

a generator assembly pressure difference determining device adapted to determine a generator assembly local pressure difference, Δp2, of the thermal energy circuit;

a thermal energy generator heat exchanger; and a flow controller, wherein the thermal energy generator heat exchanger is arranged to be connected to the cold conduit via the flow controller, wherein the flow controller comprises a mode controller configured to, based on Δp2, selectively set the flow controller in a pumping mode or in a flowing mode, wherein upon set in the pumping mode the flow controller is configured to act as a pump for pumping heat transfer liquid from the cold conduit into the thermal energy generator heat exchanger, and wherein upon set in flowing mode the flow controller is configured to act as a flow regulator for allowing heat transfer liquid from the cold conduit to flow into the thermal energy generator heat exchanger, wherein the thermal energy generator heat exchanger is further arranged to be connected to the hot conduit for allowing return of heat transfer liquid from the thermal energy generator heat exchanger to the hot conduit, and wherein the thermal energy generator heat exchanger is arranged to transfer thermal energy from its surroundings to heat transfer liquid, such that the heat transfer liquid returned to hot conduit has a temperature higher than the second temperature and preferably a temperature equal to the first temperature.

7. The local thermal energy generator assembly according to claim 6, wherein the mode controller is configured to set the flow controller in the pumping mode in case Δp2 is indicative of that a generator assembly local pressure of heat transfer liquid in the cold conduit is lower than a generator assembly local pressure of heat transfer liquid in the hot conduit, and wherein the mode controller is configured to set the flow controller in the flowing mode in case Δp2 is indicative of that the generator assembly local pressure of heat transfer liquid in the cold conduit is higher than the generator local pressure of heat transfer liquid in the hot conduit.

8. The local thermal energy generator assembly according to claim 6, wherein the flow controller further comprises:

an inlet for heat transfer liquid;

an outlet for heat transfer liquid;

a pump assembly arranged between the inlet and the outlet and configured to pump heat transfer liquid through the flow controller from the inlet to the outlet;

a flow regulator assembly arranged between the inlet and the outlet and configured to allow the heat transfer liquid flow through the flow controller from the inlet to the outlet and to generate electricity by transforming flow energy of heat transfer liquid flowing through the flow controller into electricity;

wherein upon being set in the pumping mode, the mode controller is configured to activate the pump assembly and to deactivate the flow regulator assembly;

wherein upon being set in the flowing mode, the mode controller is configured to deactivate the pump assembly and to activate the flow regulator assembly.

9. The local thermal energy generator assembly according to claim 8, wherein the flow controller further comprises a wheel, wherein the wheel is selectively operable as a pump wheel of the pump assembly to provide pump action upon the flow controller is set in the pumping mode and as a turbine wheel of the flow regulator assembly to provide hydro electrical generation upon the flow controller is set in the flowing mode.

10. The local thermal energy generator assembly according to claim 8, wherein the flow controller further comprises a first flow channel for the heat transfer liquid and a second flow channel for the heat transfer liquid, wherein the first flow channel forming part of the pump assembly and the second flow channel forming part of the flow regulator assembly.

11. A district thermal energy distribution system, comprising:

a thermal energy circuit (10) comprising two conduits for allowing flow of heat transfer liquid therethrough, wherein a hot conduit in the thermal energy circuit is configured to allow heat transfer liquid of a first temperature to flow therethrough, and wherein a cold conduit in the thermal energy circuit is configured to allow heat transfer liquid of a second temperature to flow therethrough, the second temperature is lower than the first temperature;

one or more local thermal energy consumer assemblies according to claim 1.

12. A method for controlling a thermal energy consumer heat exchanger being, via a flow controller, connected to a hot conduit configured to allow heat transfer liquid of a first temperature to flow therethrough, and being, via a return conduit, connected to a cold conduit configured to allow heat transfer liquid of a second temperature to flow therethrough, wherein the second temperature is lower than the first temperature, wherein the flow controller comprises a mode controller configured to selectively set the flow controller in a pumping mode or in a flowing mode, wherein upon set in the pumping mode the flow controller is configured to act as a pump for pumping heat transfer liquid from the hot conduit into the thermal energy consumer heat exchanger, and wherein upon set in flowing mode the flow controller is configured to act as a flow regulator for allowing heat transfer liquid from the hot conduit to flow into the thermal energy consumer heat exchanger, the method comprising:

determining a consumer assembly local pressure difference, $\Delta p1$, between heat transfer liquid of the hot conduit and heat transfer liquid of the cold conduit; and based on $\Delta p1$ selectively setting the flow controller in the pumping mode or in the flowing mode for allowing heat transfer liquid from the hot conduit to enter into the thermal energy consumer heat exchanger.

13. The method according to claim 12, wherein the act of selectively setting the flow controller in the pumping mode or in the flowing mode comprises:

in case $\Delta p1$ is indicative of that a consumer assembly local pressure of heat transfer liquid in the hot conduit is lower than a consumer assembly local pressure of heat transfer liquid in the cold conduit, setting the flow controller in the pumping mode;

in case $\Delta p1$ is indicative of that the consumer assembly local pressure of heat transfer liquid in the hot conduit is higher than the consumer assembly local pressure of heat transfer liquid in the cold conduit, setting the flow controller in the flowing mode.

14. A method for controlling a thermal energy generator heat exchanger being, via a flow controller, connected to a cold conduit configured to allow heat transfer liquid of a second temperature to flow therethrough, and being, via a return conduit, connected to a hot conduit configured to allow heat transfer liquid of a first temperature to flow therethrough, wherein the second temperature is lower than the first temperature, wherein the flow controller comprises a mode controller configured to selectively set the flow controller in a pumping mode or in a flowing mode, wherein upon set in the pumping mode the flow controller is configured to act as a pump for pumping heat transfer liquid from the cold conduit into the thermal energy generator heat exchanger, and wherein upon set in flowing mode the flow controller is configured to act as a flow regulator for allowing heat transfer liquid from the cold conduit to flow into the thermal energy generator heat exchanger, the method comprising:

determining a generator assembly local pressure difference, $\Delta p2$, between heat transfer liquid of the hot conduit and heat transfer liquid of the cold conduit; and based on $\Delta p2$ selectively setting the flow controller in the pumping mode or in the flowing mode for allowing heat transfer liquid from the cold conduit to enter into the thermal energy generator heat exchanger.

15. The method according to claim 14, wherein the act of selectively setting the flow controller in the pumping mode or in the flowing mode comprises:

in case $\Delta p2$ is indicative of that a generator assembly local pressure of heat transfer liquid in the cold conduit is lower than a generator assembly local pressure of heat transfer liquid in the hot conduit, setting the flow controller in the pumping mode;

in case $\Delta p2$ is indicative of that the generator assembly local pressure of heat transfer liquid in the cold conduit is higher than the generator assembly local pressure of heat transfer liquid in the hot conduit, setting the flow controller in the flowing mode.

* * * * *